United States Patent [19]

McGhie

[11] 4,060,179

[45] Nov. 29, 1977

[54] COLLAPSIBLE TUBE STRUCTURE

[75] Inventor: Russell Park McGhie, Somers, N.Y.

[73] Assignee: Colgate-Palmolive Company, New York, N.Y.

[21] Appl. No.: 492,213

[22] Filed: July 26, 1974

Related U.S. Application Data

[63] Continuation of Ser. No. 249,658, May 2, 1972, abandoned.

[51] Int. Cl.[2] ..... B65D 35/00

[52] U.S. Cl. ..... 222/92; 220/67

[58] Field of Search ..... 222/92, 107, 94, 206, 222/215; 220/66, 67; 229/5.7

[56] References Cited

U.S. PATENT DOCUMENTS

| | | | |
|---|---|---|---|
| 1,233,802 | 7/1917 | Lowe et al. | 222/107 |
| 1,322,426 | 11/1919 | Gearhart | 222/107 |
| 2,101,855 | 12/1937 | Henderson | 229/5.7 |
| 3,832,964 | 9/1974 | Rockefeller | 222/92 |

FOREIGN PATENT DOCUMENTS

| | | | |
|---|---|---|---|
| 905,617 | 4/1945 | France | 222/92 |
| 529,433 | 7/1955 | Italy | 222/107 |
| 194,063 | 11/1937 | Switzerland | 222/92 |
| 580,022 | 8/1946 | United Kingdom | 222/92 |
| 525,357 | 8/1940 | United Kingdom | 222/107 |
| 312,262 | 1/1930 | United Kingdom | 222/92 |

*Primary Examiner*—Robert B. Reeves
*Assistant Examiner*—H. Grant Skaggs
*Attorney, Agent, or Firm*—Strauch, Nolan, Neale, Nies & Kurz

[57] ABSTRACT

A collapsible tube assembly comprises a flexible tubular body of ductile metal, plastic or a lamination thereof, and a dispensing head structure of relatively stiff solid non-metallic plastic comprising inner and outer nested elements each having an annular shoulder and an annular longitudinal skirt, an annular end region of the body being inwardly turned to be clamped longitudinally between said shoulders and an adjacent annular portion of the body being frictionally radially clamped between the skirts.

4 Claims, 6 Drawing Figures

FIG. 1
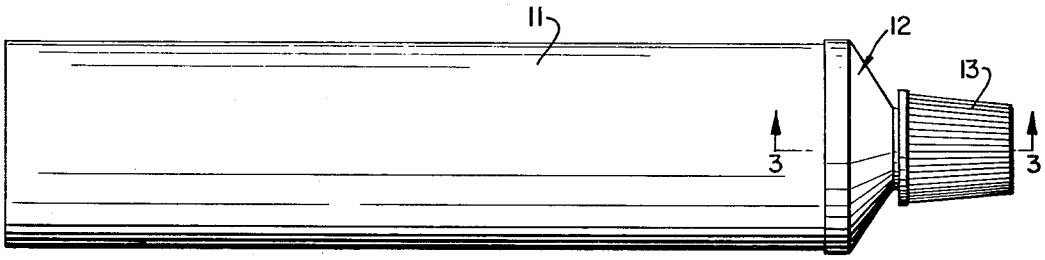
FIG. 2
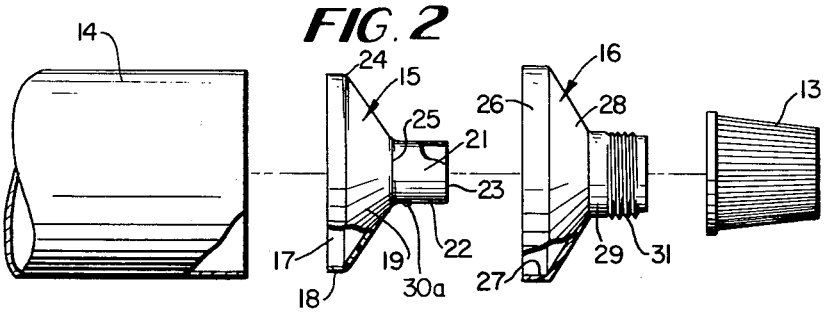
FIG. 3
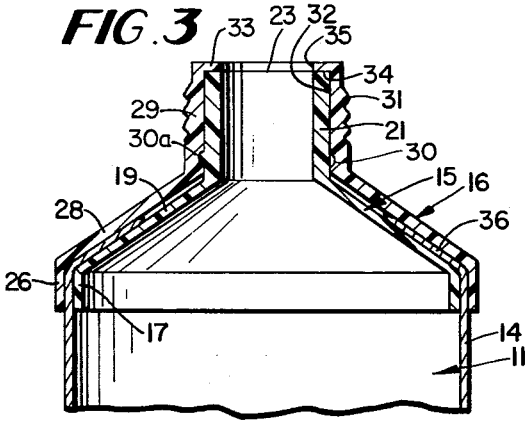
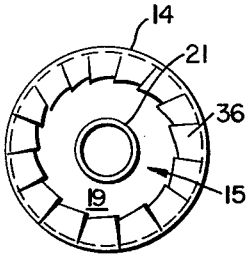
FIG. 4
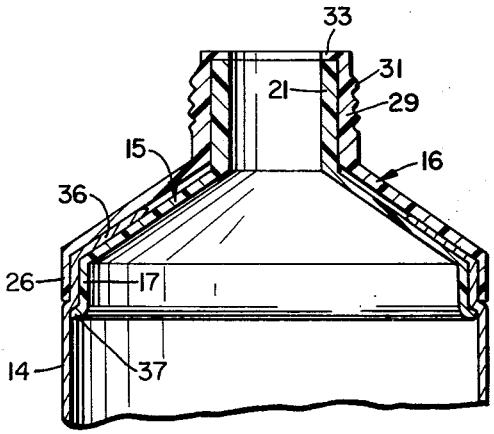
FIG. 5
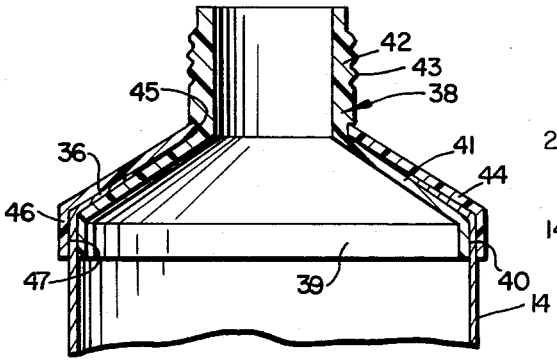
FIG. 6

COLLAPSIBLE TUBE STRUCTURE

This is a continuation, of application Ser. No. 249,658, filed May 2, 1972, now abandoned.

This invention relates to collapsible tubes of the dispensing type commonly used for the packaging of toothpaste, creams, pastes and like fluent materials, and is particularly concerned with the head structure at the dispensing end of the tube.

It has been long and common practice to package such materials in depensing tubes having flexible bodies composed of ductile metal, flexible plastic or combinations including laminations of metal and plastic. The packaging and dispensing of toothpaste, with which the invention is concerned in a preferred embodiment, presents problems toward the solution of which many patented proposals have been made.

One problem arises from the fact that certain materials such as toothpaste may contain abrasive particles. The conventional dispensing head in these tubes usually comprises an externally threaded nozzle of small diameter compared to the tube body and adapted to receive a thread closure cap. Where the tube and head are integrally formed of a ductile metal, and in substantially all cases where the nozzle is metal, the most preferable and used metal being aluminum or an alloy of aluminum mainly because of availability, cost and ease of handling, the repeated on and off operation involving the closure cap usually traps some of the abrasive containing material between the threads where it abrades the metal and results in unsightly greyish or colored deposits.

Partially in recognition of the foregoing, and partially in view of the possibility of making tubes of flexible plastic as an economic factor, it has been proposed to provide dispensing tubes that are either wholly composed of plastics or comprise metal bodies having dispensing head structures that are wholly or at least in the threaded nozzle region composed of plastic material. Exemplary of such proposals are the U.S. Pat. Nos. to Roselle 2,274,258; McGeorge 2,794,574; Fleissig 2,184,712; Voke 2,383,230 and Loew 2,965,964.

As the art has developed over the years an important phase has been the attachment of flexible metal or laminated metal-nonmetal bodies to polyethylene or equivalent thermoplastic head structures consisting essentially of a shoulder adapted for attachment to the body and an integral externally threaded reduced diameter externally threaded nozzle. Also it has been proposed to internally line the body with a polyolefin such as polyethylene non-reactive or impermeable to certain products to be packaged. Examples of the foregoing are seen in the U.S. Pat. Nos. to Anderson 3,599,837 and Dobson 3,260,411. In tubes with polyethylene head structures, certain products have exhibited product migration and oxygen absorption through the polyethylene. Usually this problem is overcome in the body by providing a laminated wall containing a layer of aluminum externally of any polyethylene layer which aluminum layer is impermeable to the product or oxygen. Such tubes have in the past been provided with molded-in inserts of an impermeable barrier material such as urea formaldehyde which effectively lined the polyethylene shoulder and nozzle. As an example of this stage of the art, attention is directed to Schultz U.S. Pat. No 3,565,293.

Despite all of the research and work that has gone into the guest for production of a satisfactory flexible dispensing tube, none of the foregoing has been entirely commercially acceptable. For one thing the molding and deformation of thermoplastic head structures to the tube bodies is both exacting and relatively expensive and requires special equipment, and as in all operations where heat is required time is lost in cooling the assembly which limits the speed of production.

The present invention departs from the known scope and content of the prior art represented by the patents above identified by providing for a relatively rapid mechanical attachment of a plastic head structure to a metal, preformed plastic or laminated metal-nonmetal tube body wherein the body wall is effectively radially clamped with a friction force fit in an annular band between inner and outer head element skirts, and this is the major advantage of the invention.

More specifically the invention adantageously provides a novel assembly and mode of assembly of a collapsible dispensing tube wherein the body of the tube is a hollow cylinder of metal, plastic or metal-nonmetal lamination, and the head structure consists essentially of inner and outer elements that have coextensive shoulders clamping the inturned end region of the body between them and coextensive skirts between which an adjacent annular portion of the body is frictionally clamped.

Further advantages will appear as the disclosure proceeds in connection with the annexed claims and the appended drawings.

BRIEF DESCRIPTION OF DRAWINGS

FIG. 1 is an elevation showing a collapsible tube assembly incorporating a preferred embodiment of the invention;

FIG. 2 is an exploded view showing the major parts of the FIG. 1 assembly;

FIG. 3 is a section showing structural detail of the assembly;

FIG. 4 is an end view showing one stage in the assembly of FIG. 1;

FIG. 5 is a section similar to FIG. 4 but showing a further modification; and

FIG. 6 is a section showing a still further modification.

DEFERRED EMBODIMENTS

Referring to FIG. 1, the collapsible tube assembly comprises a tubular body 11 to which is attached a dispensing head structure 12 having a closure cap 13. FIG. 2 shows the parts which make up the assembly. They comprise a length of flexible metal tubing 14 that is initially a constant diameter cylinder, an inner head element 15, an outer head element 16 and closure cap 13.

Tubing 14 is preferably aluminum or an aluminum alloy having a sufficiently thin wall as to be capable of being repeatedly flexed to dispense the product in body 11 through the head structure when the cap is removed. Also the material of tube 14 should be ductile so as not to rupture when flexed but of relatively low resiliency so that it can be bent over and crimped to a dead fold position that it will end to maintain as will appear.

Head element 15 is a unitary part made of a relatively stiff hard non-metallic plastic material which has relatively low permeability with respect to the tube contents. For example, where the body contains certain toothpastes it has been found advantageous to mold or cast head element 15 of a suitable amino resin such as urea formaldehyde. Head element 15 has a skirt 17 having a smooth cylindrical external surface 18, a generally conical sloping smooth surfaced shoulder 19 and a hollow neck 21 having a smooth cylindrical external surface 22. Surfaces 18 and 22 are concentric with the axis of the element, and a flat smooth annular face 23 is provided on the end of the neck lying in a plane perpendicular to the axis of the element. The junction corners at 24 between skirt 17 and shoulder 10, and at 25 between shoulder 19 and neck 21 are preferably smooth small curvature annular regions presenting no sharp corners.

Head element 16 is a unitary molded part made of a relatively stiff plastic material and preferably it has some resilient characteristic for incorporation into a force fit assembly as will appear. A preferred material is polypropylene which is thermoplastic. Head element 16 comprises a skirt 26 having a smooth cylindrical internal surface 27, a generally conical sloping shoulder 28 and a hollow neck 29 which is externally threaded at 31 for attachment of cap 13. As shown in FIG. 3 the interior of neck 29 comprises a smooth cylindrical surface 32, capable of snugly slidably receiving neck 21 of the inner head element. At the outer end of surface 32 is an inturned flange 33 defining an annular inwardly facing flat surface 34 lying in a plane perpendicular to the axis of the element, and adapted for abutment by the end face 23 of the inner head element neck when the parts are in assembly. The internal surface 35 of flange 33 is cylindrical and substantially a continuation of the inner cylindrical surface of neck 21.

In assembly the open end of cylindrical metal tube 14 is axially moved to surround and pass beyond skirt surface 18 of the inner head element. The smooth inner diameter of tube 14 is so sized that it has a snug close sliding fit with surface 18. In practice the open end of the tube may expand circumferentially a small amount as permitted by its ductile characteristics to pass over surface 18 even though that surface may be of slightly greater diameter. Since head element 15 is relatively hard and non-yielding and surface 18 is smooth, this operation is efficient and speedy.

The tube 14 is advanced until the leading edge has passed a short distance axially beyond juncture 24, and then the annular leading end region 36 is bent inwardly over juncture 24 to closely and relatively flatly overlie the outer surface of shoulder 19, as shown in FIG. 4. Since the circumference of shoulder 19 decreases toward the neck 21, the bent over leading end region 36 of tube 14 will be radially randomly crimped.

Now the outer head element is forced onto the inner head element 15 until the neck 21 telescopes within neck 29 and abuts against flange 33. Skirt 26 surrounds skirt 17 with an annular smooth walled section of tube 14 between them, and the inturned end region 36 of the tube is tightly clamped longitudinally of the assembly between the coextensive head element shoulders 19 and 28. The radius of cylindrical surface 27 is larger than the radius of external cylindrical surface 18 only by an amount substantially equal to the metal wall thickness of tube 14, so that in effect the foregoing assembly creates a continuously annular friction tight wedge-type radial mechanical interlock and seal between the head structure and the tube body. The flexibility of polyethylene skirt 26 and the ductility of the metal tube wall contribute to the efficiency of this joint.

As shown in FIG. 3 the inside of neck 29 may be formed with an internal groove 30 to enable it to flex during assembly and assume a tight fit with neck 21. Further an annular rib **30*a* can be provided on neck 21 to engage with groove 30 to provide a snap lock joint between the necks 29, 21**.

The embodiment shown in FIG. 5 differs over that of FIGS. 1–4 in that around the lower edge of skirt 17 of the inner head element is formed a shallow external circular flange 37 over which the wall of tube 14 passes in the assembly. As shown exaggeratedly in FIG. 5 when the inner and outer head elements are assembled, an additional annular tight interlock and seal is formed where the tube wall is clamped between the lower edge of skirt 26 and the flange 37. Also as shown in FIG. 5, the outer diameters of the tube body and skirt 26 are essentially the same so that they appear as peripherally continuous.

In the embodiment of FIG. 6, the inner head element 38 is a unitary part made of a barrier material such as urea formaldehyde and comprises a skirt 39 having an external cyindrical surface 40, a sloping shoulder region 41 and a hollow neck 42 which is externally formed with threads 43 for attachment of cap 13. The outer head element 44 is in the form of an annular frusto conical shoulder of polypropylene shaped to overlie shoulder 41. The upper edge of ring 44 may fit into an annular notch 45 below the threads on neck 42. Around its lower edge shoulder 44 is formed with an annular skirt 46 having an internal cylindrical surface 47 that surrounds inner skirt surface 40, being spaced therefrom only by the wall thickness of tube 14 as in the other embodiments.

In the assembly of FIG. 6 inturned crimped end 36 of the tube 14 is trapped and compressed between the similarly sloping shoulders 41 and 44, and the adjacent wall of the tube has an annular force fit mechanical interlock seal with the head structure as in the other embodiments.

In a practical construction according to the foregoing, an aluminum toothpaste tube body about 1⅛ inches in diameter is fitted over an inner head element so as to provide a crimped bent over region about ⅛ inch long clamped between the respective sloping shoulders. The mechanical interlock provides adequate resistance to longitudinal separation of the head structure from the tube body due to normal axial pull, and the frictional tightness of the joint provides an adequately fluid tight seal.

While the invention is described in its preferred form for incorporating an aluminum walled tube with respective polyethylene and urea formaldehyde head elements, it will be understood that the invention is not limited to those specific materials. For example, the head elements may be composed of any materials having the characteristics desired, and the tube wall may be a metal-nonmetal laminate of suitable characteristics. It is also contemplated that the tube body wall may be an extruded plastic cylinder.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A collapsible tube assembly comprising a tubular body having a flexible side wall that includes a sheet of ductile metal coextensive throughout, a dispensing head structure of relatively stiff solid non-metallic synthetic plastics material at one end of said body, said head structure comprising an integral inner element composed of relatively hard synthetic plastics material having an annular tapered shoulder and an annular skirt around the larger end of the shoulder having an external smooth cylindrical surface extending longitudinally from an annular corner junction with the outer periphery of said shoulder, said body at one end having a longitudinally extending cylindrical wall region of appreciable area closely surrounding said cylindrical skirt surface and terminating in an annular end region inwardly turned over said junction to overlie the outer surface of said shoulder in a substantially dead fold crimped condition, and an integral outer element of said head structure composed of a relatively resilient synthetic plastic material having an annular tapered shoulder closely overlying said shoulder of the inner head element to clamp said crimped inturned body end region between said shoulders to anchor said body against longitudinal separation from said head structure, a reduced diameter hollow neck projecting axially from the smaller end of the shoulder of said outer head element, a hollow neck projecting axially from the smaller end of the shoulder of said inner element axially forced into a tight smooth surfaced friction fit within and lining said neck of the outer head element, and a longitudinally extending annular skirt around the larger end of the shoulder having an internally smooth cylindrical surface extending longitudinally from an annular corner junction with the outer periphery of the shoulder of said outer head element closely surrounding said cylindrical wall region of the body, said skirts being longitudinally coextensive for a sufficient distance from their respective shoulder junctions to define a longitudinal space between them of constant thickness wherein said cylindrical wall region of the body is tightly radially clamped with a force fit to provide a fluid tight seal independent of the anchor between said shoulders.

2. The collapsible tube assembly defined in claim 1, wherein said outer head element is a molded polyethylene unit and the inner head element is a preformed urea formaldehyde unit, and said body comprises at least one layer of ductile metal.

3. A collapsible tube assembly comprising a flexible tubular body having a coextensive layer of ductile metal and a dispensing head structure secured upon one end of said body, said head structure comprising an integral inner hollow head element composed of relatively hard synthetic plastics material having an inclined annular shoulder, a reduced diameter nozzle lining section projecting longitudinally from the inner periphery of said shoulder, an annular skirt projecting longitudinally from the outer periphery of said shoulder and a narrow annular external flange at the free end of said skirt, and an outer hollow head element composed of a relatively resilient synthetic plastics material disposed in tight substantially nested relation with said inner element, said outer element having an annular shoulder of corresponding inclination with and surrounding the annular shoulder of said inner element, a longitudinally extending nozzle section surrounding said lining section of the inner element with a smooth surfaced friction tight fit, and a longitudinally extending skirt surrounding the skirt of the inner element with the outer diameter of the skirt of said outer element being substantially equal to the outer diameter of said body one end whereby said tube body and outer head element appear to be peripherally continuous, said body one end extending over said external flange and then being bent inwardly at an angle in a first annular portion, then extending longitudinally between said skirts and then being bent inwardly at a second annular portion to pass between said shoulders to terminate in an annular crimped dead fold region axially clamped between said shoulders tightly whereby said tube body and head structure are so mechanically interlocked as to resist axial separation of the tube body and head structure due to normal axial pull.

4. A collapsible tube assembly as defined in claim 3, wherein the tube body is clamped between said flange and the lower edge of the skirt of said outer element.

* * * * *